United States Patent [19]

McGill et al.

[11] Patent Number: 4,824,361

[45] Date of Patent: Apr. 25, 1989

[54] SMOKE SUPPRESSANT APPARATUS FOR FLARE GAS COMBUSTION

[75] Inventors: Eugene C. McGill, Skiatook; Robert L. Rawlings, Tulsa, both of Okla.

[73] Assignee: McGill Incorporated, Tulsa, Okla.

[21] Appl. No.: 485,623

[22] Filed: Apr. 18, 1983

Related U.S. Application Data

[63] Continuation-in-part of Ser. No. 365,588, Apr. 5, 1982, Pat. No. 4,538,982, which is a continuation-in-part of Ser. No. 431,180, Sep. 30, 1982, abandoned.

[51] Int. Cl.[4] ..... F23D 00/00

[52] U.S. Cl. ..... 431/202; 431/114; 431/5

[58] Field of Search ..... 431/202, 4, 5, 114

[56] References Cited

U.S. PATENT DOCUMENTS 3,994,671 11/1976 Straitz ..... 431/202

4,188,783 2/1980 Zink ..... 431/202

*Primary Examiner*—Kenneth J. Dorner

*Assistant Examiner*—Gerald A. Anderson

*Attorney, Agent, or Firm*—Bill D. McCarthy

[57] ABSTRACT

An improved smoke suppressant apparatus for flare gas combination comprising a flare housing and a liner cylinder member coaxially disposed therewithin, an annular orifice channel formed between the liner cylinder and the flare housing. A first flare conduit is in fluid communication with the orifice channel and a first flare gas portion passing through the flare conduit is discharged from the orifice channel at the upper end of the flare housing as a perimeter zone discharge configured as a relatively thin cylindrical layer of flare gas. A second flare conduit may be provided in fluid communication with the inner core of the liner cylinder to discharge a second flare gas portion therethrough as an inner zone discharge, and a liquid seal is provided to permit flare gas to pass via the second flare conduit only when the pressure of the inlet flare gas exceeds a predetermined value. A fluid injected assembly is disposed within the upper end portion of the liner cylinder member for discharging a pressurized fluid into the perimeter zone discharge. A second fluid injector assembly may also be disposed around the upper end portion of the flare housing for discharging a pressurized fluid into the perimeter zone discharge.

2 Claims, 5 Drawing Sheets

SMOKE SUPPRESSANT APPARATUS FOR FLARE GAS COMBUSTION

This application is a continuation-in-part to U.S. application Ser. No. 365,588, entitled "Flare Gas Combustion Apparatus", filed Apr. 5, 1982, now Pat. No. 4,538,982, and CIP Ser. No. 431,180 filed Sept. 30, 1982, now abandoned.

BACKGROUND ART

The present invention relates to combustion devices which are designed for the disposal of flare gases by the process of combustion, and more particularly but not by way of limitation, to an improved flare gas combustion apparatus for the smokeless burning of hydrocarbon gases and vapors.

There are many facilities, such as refineries, that must dispose of flare gases in a safe and effective manner as directed by both local and federal governmental regulations. Prior art devices to accomplish this usually include a flare stack having a flare tip disposed sufficiently high enough above the terrain to disperse the combusted gaseous products into the prevailing wind and limit the thermal radiation to safe levels. It is to be expected, especially in view of recent clean air laws and ordinances, that the combustion must be complete and smokeless to minimize environmental disturbance. It is also desirable to have such devices capable of handling quantities of gases in excess of normal discharge loads during temporary plant upsets. Further, it is usually desirable to have a purge reduction device and/or a flash back prevention device which protects the plant from any inner conduit combustion.

Prior art devices typically use steam or air as a smoke suppressant, and the flare tip must deliver steam and air in adequate quantities to promote rapid mixing of these suppressants and gases in the combustion zone at the upper end of the stack. The steam serves to break up the discharging flare gas and promote more complete combustion. There are numerous such prior art devices which have been designed to effect smokeless, flare tip combustion of flare gases.

For example, U.S. Pat. No. 2,779,399, issued to Zink and Reed, teaches a flare tip structure to combust flare gas comprising hydrocarbons and other flammable raw materials. A flare stack tube has a main gas flare tip mounted at its upper end, and a sleeve surrounds the upper end of the tube forming an annular space about the flare stack. The purpose of the annular space is to communicate air and steam into the burning flare gas discharging from the flare stack tip. Steam is sprayed into the burning mass of gas via a centrally disposed tubular member and a manifold surrounding the burning tip; thus steam and air are drawn into the flame mass.

U.S. Pat. No. 3,512,911, also issued to Zink and Reed, teaches the use of air and steam which is directed into the center of the flare tip to break up the flame by developing turbulence to mix the steam and air with the flare gas to promote smokeless burning.

U.S. Pat. No. 3,547,567, issued to Turpin, teaches a flare stack combustion tip which breaks up the main gas flow into plural flow segments. The flare tip is affixed to the top of a flare stack or to the top of a centrally disposed flare gas conduit, the tip having a plurality of gas conducting channels which serve as gas emission orifices through which the flare gas is discharged for burning. Steam and air are directed through a shroud which surrounds the flare tip.

U.S. Pat. No. 3,554,631, issued to Procter, teaches a flare stack tip which attaches to the upper end of a flare stack. Rows of air-inducing devices are disposed to drive steam and air into the tip to mix with the flare gas flowing up through the stack, with the air-inducing devices operating under the Coanda principle. Proctor's later patent, U.S. Pat. No. 3,914,093, teaches a further development in a Coanda inducing device.

While most of the prior art flare gas combustion devices, including those taught by the above mentioned patents, provided devices which achieved varying degrees of success, they were generally expensive to fabricate and/or to operate, and experienced high maintenance costs. Devices which served to break up the "log mass" of the flare gases (so called because of the large tubular mass discharge from most prior art flare stacks) involved devices having components subjected directly or indirectly to the intense heat of the flame by placing the operating components in or near the flame mass, resulting in early burn out of the components. High operating expense incurred by the use of steam in quantities sufficient to suppress large masses of flare gases often diminishes the value of otherwise well designed flare combustion devices.

SUMMARY OF THE INVENTION

The present invention provides an improved flare gas combustion apparatus which effects the smokeless combustion of hydrocarbon gases and vapors by configuring the flare gas into a perimeter zone discharge shaped to break up the central log effect created by a mass of flare gas discharging from a flare stack.

The flare gas combustion apparatus of the present invention comprises a flare housing and a gas directing means disposed within the flare housing forming an orifice channel with the flare housing. A first flare conduit in fluid communication with the orifice channel passes a first flare gas portion through the orifice channel to exhaust the flare gas via a exit port of the orifice channel at the upper end of the flare housing into a perimeter zone discharge.

In one embodiment, a liner member is supported within the flare housing, forming an orifice channel between the inner wall of the flare housing and the outer wall of the liner member, with the first flare gas portion discharging from the orifice channel in the form of a perimeter zone discharge. Fluids, such as steam, air, natural gas, water or a combination of such fluids, can be directed into the perimeter zone discharge.

In one embodiment, an overflow condition is accommodated via a second flare conduit which is capable of passing flare gas in excess of normal operating conditions by discharging a portion of the flare gas as an inner zone discharge.

An object of the present invention is to provide an improved flare gas combustion apparatus which provides smokeless flare combustion of hydrocarbon gases and the like.

Another object of the present invention, while achieving the above object, is to provide a flare gas combustion apparatus having smokeless flame combustion capability while providing ease of component fabrication.

Another object of the present invention, while achieving the above stated objects, is to provide an improved flare gas combustion apparatus which is substantially more economical to operate and to maintain.

Another object of the present invention, while achieving the above stated objects, is to provide an improved flare gas combustion apparatus which requires less energy to achieve its function.

Another object of the present invention, while achieving the above stated objects, is to provide an improved flare gas combustion apparatus which provides better mixing of fluids with the discharging flare gas to facilitate substantially complete smokeless combustion.

Another object of the present invention, while achieving the above stated objects, is to provide an improved flare gas combustion apparatus which minimizes the amount of purge gas required to retard atmospheric air from backflowing into the flare stack through the discharge end of the stack.

Another object of the present invention, while achieving the above stated objects, is to provide a flare gas combustion apparatus which retards flash back combustion to protect the plant from inner conduit combustion.

Other objects, features and advantages of the present invention will become clear from the disclosure provided hereinbelow when read in conjunction with the included drawings and appended claims.

BRIEF DESCRIPTION OF THE DRAWINGS

FIG. 6 is a partial cutaway view of yet another flare tip assembly.

FIG. 8 is a partial cutaway view of still another flare tip assembly.

FIG. 9A shows a cross sectional cutaway view of a portion of the exit port of the annular orifice channel of the flare tip assembly of FIG. 8 illustrating a restriction member having a rectangularly shaped cross section.

FIG. 9B shows a cross sectional cutaway view of a portion of the exit port of the annular orifice channel of the flare tip assembly of FIG. 9 illustrating a restriction member having a circular shaped cross section.

DESCRIPTION OF THE INVENTION

The present invention relates to the smokeless burning of hydrocarbon gases and vapors as in an emergency relief flare system and the like. As mentioned above, prior art flare combustion devices utilize high pressure steam, usually 100 psig and greater, to mix with a hydrocarbon flame mass to effect smokeless burning. The steam is used at a rate of about 0.3 to 0.4 pounds of steam consumption per pound of flare gas burned. It is clear that maximum utilization of flame breakup must be achieved while conserving the amount of steam used, or the amount of steam that would be required would become cost prohibitive. The present invention presents a unique solution to flare gas combustion because it configures the waste gas discharge into a relatively thin, perimeter zone discharge in the form of a cylindrical layer that can be caused to diverge as desired to more easily turbulate with steam and air.

Figure 1:
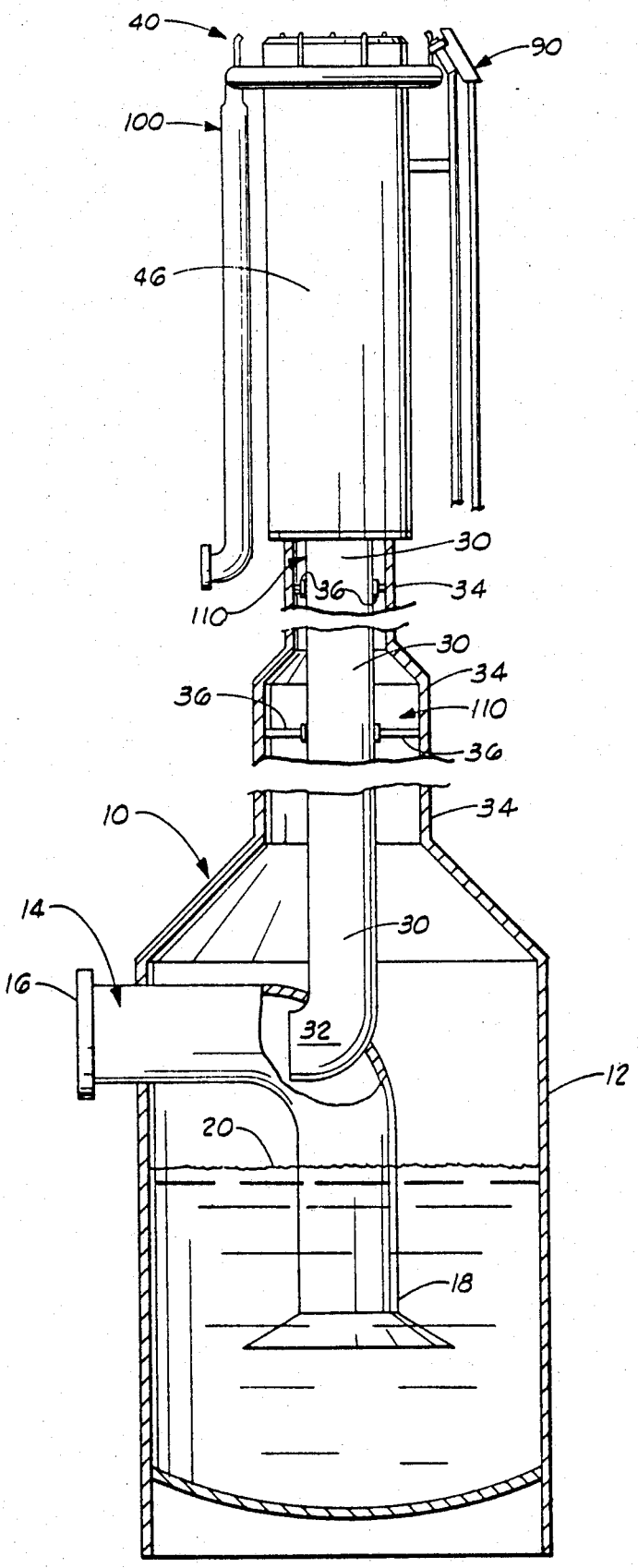
FIG. 1 shows a partial cutaway, cross-sectional view of a two stage flare gas combustion apparatus constructed in accordance with the present invention.

Referring to the drawings in general, and with specific reference to FIG. 1, shown therein is a flare gas combustion apparatus 10 which is shown in partial cutaway, cross-sectional view. Some of the length of the flare gas combustion apparatus 10 has been omitted in order to show the apparatus in greater detail in FIG. 1. As will become clear, the flare gas combustion apparatus 10 is a two stage apparatus which is designed to process flare gases during normal operations via a first flare conduit and to utilize a second flare conduit to handle quantities of flare gas in excess of normal operations.

The flare gas combustion apparatus 10 comprises a lower portion or seal tank 12 having a flare gas inlet conduit 14. The flare gas inlet conduit 14 is a generally L-shaped conduit having a first end 16 and a second end 18. The first end 16 of the flare gas inlet conduit 14 is adapted to receive a flare gas from a facility, such as a refinery, and the second end 18 of the flare gas inlet conduit 14 is turned downwardly into the seal tank 12. A liquid, such as water, is maintained in the seal tank 12 so as to provide a liquid level 20 in the seal tank 12 which is disposed above the second end 18 of the flare gas inlet conduit 14.

Figure 2:
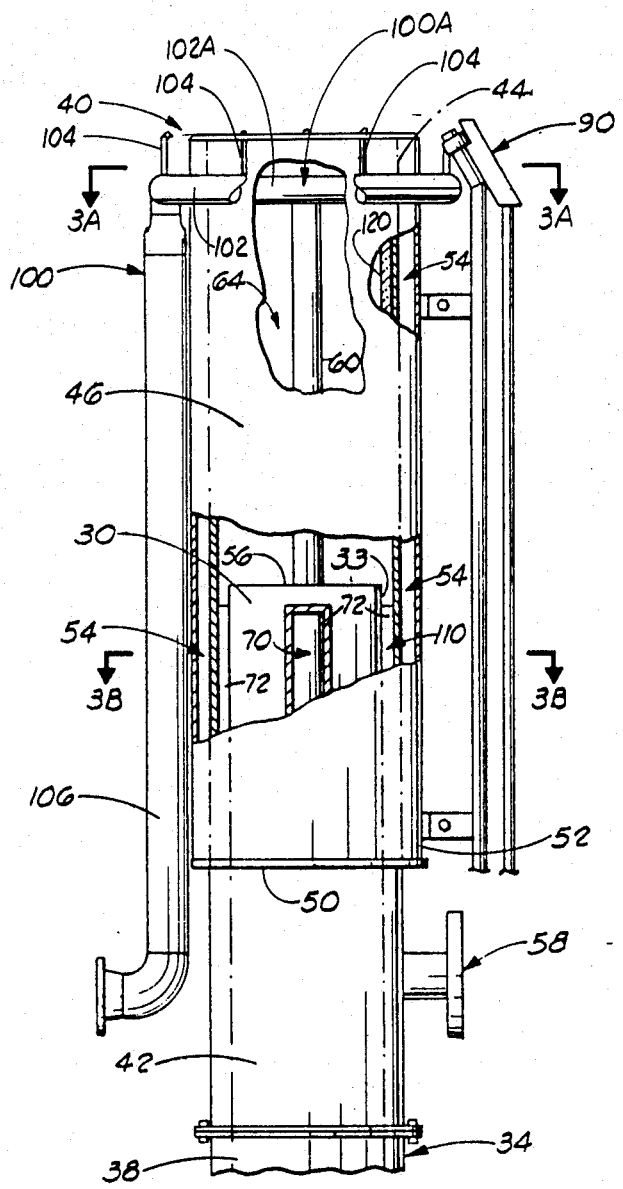
FIG. 2 shows a partial cutaway view of the flare tip assembly of FIG. 1.

A first flare conduit 30 has a lower end 32 which extends through the wall of the flare gas inlet conduit 14 and is sealed thereto to be disposed in flare gas receiving relationship to the flare gas inlet conduit 14 in the manner shown; and the first flare conduit 30 has an upper end 33 which is viewable in the partial cutaway view of FIG. 2. The first flare conduit 30 extends upwardly and is supported by an outer stack, or second flare conduit, 34 which is attached to and communicates with the seal tank 12. For structural strength, the second flare conduit 34 may neck down in diameter in stages in conventional fashion as shown, or external support may be provided, such as by guy wires or by a supporting derrick. The first flare conduit 30 and the second flare conduit 34 are substantially coaxially disposed to each other, and a number of support members 36 extend therebetween to unitize these two structures.

Attached to an upper end 38 of the second flare conduit 34 is a flare tip assembly 40 shown in partial cutaway cross-sectional view in FIG. 2. The flare tip assembly 40 comprises a bolt-on section, hereinafter referred to as a liner member 42, which extends upwardly from the second flare conduit 34 and has an upper end 44. The flare tip assembly 40 also comprises a cylindrically or tubularly shaped flare housing 46 which is supported by a number of vertical divider members 48, viewed in FIG. 3A, which attach to the outer wall of the liner cylinder member 42, and by an annular bottom plate 50 which is welded to the outer wall of the liner cylinder member 42 at its lower end 52. Formed between the coaxially disposed liner cylinder 42 and the flare housing 46 is an annular orifice channel 54 having an exit port 55 (shown in enlarged cross sectional view in FIG. 4) at the upper end 44 of the liner cylinder 42. The annular orifice channel 54 is sealed at the lower end 52 by the bottom plate 50. The exit port 55 of the annular orifice channel 54 is defined by a first deflector ring 57 supported by an upper end 59 of the flare housing 46, and a second deflector ring 61 supported by the upper end 44 of the liner cylinder member 42. The first and second deflector rings 57, 61 are angularly disposed in a converging direction substantially as shown.

The upper end 33 of the first flare conduit 30 extends into the liner cylinder member 42 and terminates below the upper end 44 thereof. The upper end 33 is capped with a plate 56. A fluid injector pipe 58 extends through the walls of the liner cylinder 42 and the first flare conduit 30 and has a vertically extensive leg 60 which extends through the plate 56. The end of the injector pipe 58 is connected to and in fluid communication with an internally disposed fluid injector assembly 100A which is disposed below the upper end 44 of the liner cylinder 42 and serves to inject a fluid, such as steam, air, natural gas, water or combinations of such fluids, into the perimeter zone discharge. The internally disposed fluid injector assembly 100A is connected to a source of pressurized fluid, such as air, natural gas, steam, water or combinations of such fluids.

Figure 3A:
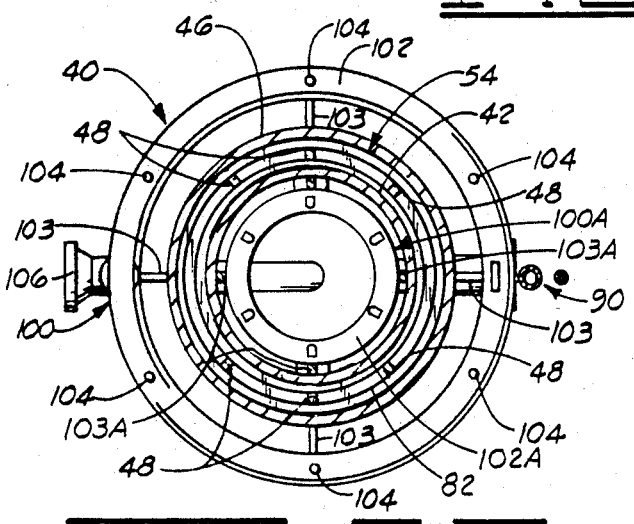
FIG. 3A shows a view of the annular orifice channel of the flare tip assembly taken at 3A—3A in FIG. 2.
Figure 4:
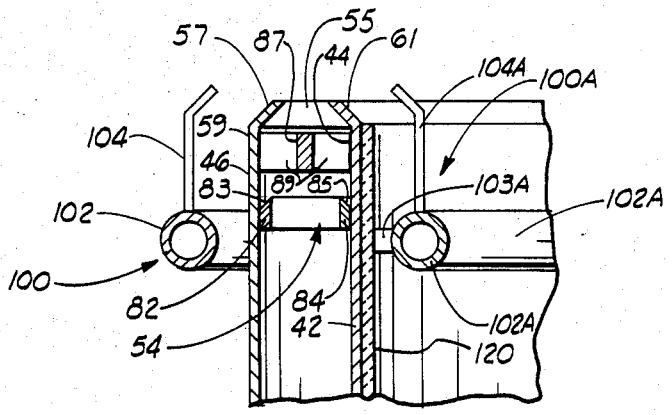
FIG. 4 shows a cross-sectional cutaway view of a portion of the exit port of the annular orifice channel of the flare tip assembly of FIG. 2.

The internally disposed fluid injector 100A comprises a hollow pipe ring 102A supported within the liner cylinder member 42 below the upper end 44 thereof via stand off members 103A (shown in FIG. 3A). The hollow pipe ring 102A has a plurality of discharge apertures, and located about the pipe ring 102A are a plurality of fluid nozzles 104A that communicate with the discharge apertures. Each fluid nozzle (only a few are shown in the drawings, but the number may be established as required) extend upwardly from the pipe ring 102A and is disposed to discharge fluid toward the perimeter zone discharge as shown in FIG. 4.

Figure 3B:
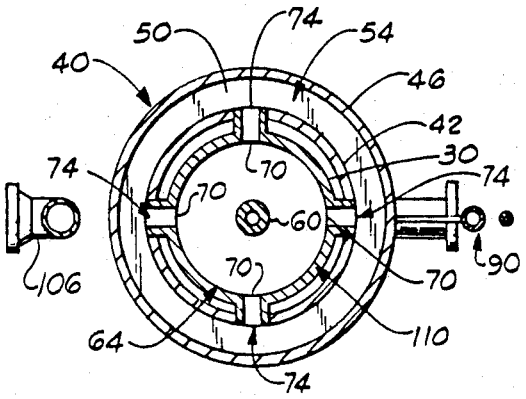
FIG. 3B shows a view taken at 3B—3B in FIG. 2.

As shown in FIGS. 2 and 3B, the first flare conduit 30 communicates with the annular orifice channel 54 via a plurality of flow openings 70 disposed about the upper end 33 thereof. A like number of conduits 72 connect to and extend radially from the first flare conduit 30 and connect to the liner cylinder member 42 at similarly located flow openings 74 such that fluid communication is established between the first flare conduit 30 and the annular orifice channel 54. Referring to FIG. 3A in combination with FIGS. 2 and 3B, the divider members 48 extend only for a portion of the length of the liner cylinder member 42 and serve to compartmentize the annular orifice channel 54. Flare gas passes from the first flare conduit 30 to the annular orifice channel 54 via the conduits 72 and passes upwardly through the annular orifice channel 54 to discharge via the exit port 55 (see FIG. 4) as a relatively thin layer of discharge gas from the upper end of the flare tip assembly 40. That is, the flare gas discharging from the annular orifice channel 54 via the exit port 55 forms a perimeter zone discharge.

In the operation of the flare gas combustion apparatus 10 there are times when the amount of flare gas passing through the annular orifice channel 54 is small or purge gases are being directed through the first annular orifice channel 54 because of the unavailability of flare gas. In such instances the kinetic energy of the flare gas or purge gases may not be sufficient to prevent air from entering the annular orifice channel 54 via the exit port 55 and migrating downwardly along the interior surfaces of the annular orifice channel 54. Referring now to FIG. 4, to prevent the downward flow of air into the annular orifice channel 54 a first ring plate member 82 is disposed within the annular orifice channel and secured to the inner wall of the flare housing 46 so as to provide a partial restriction in the annular orifice channel 54. The first ring plate member 82 is desirably secured to the flare housing 46 so as to be disposed within the upper portion of the annular orifice channel 54. The first ring plate member 82 is provided with an upper beveled end portion 83 and is secured to the inner wall of the flare housing 46 so that the beveled end portion 83 forms an acute angle with the elongated axis of the flare housing 46 substantially as shown in FIG. 4. A second ring plate member 84 is disposed within the annular orifice channel 54 and secured to the outer wall of the liner cylinder member 42 so as to be disposed substantially opposite the first ring plate member 82 and provide a partial restriction in the annular orifice channel 54. The second ring plate member 84 is also provided with an upper beveled end portion 85. The second ring plate member 84 is disposed within the annular orifice channel 54 and secured to the outer wall of the liner cylinder member 42 so that the beveled end portion 85 forms an acute angle with the elongated axis of the liner cylinder member 42 as shown.

The first and second ring plate members 82 and 84 have been described and illustrated as separate members. However, it is to be understood that such members can be fabricated as a unitary conical shaped ring member having a centrally disposed opening therein such that the flare and/or purge gases can be passed through the centrally disposed opening and the conical surface prevents air from migrating downwardly along the interior surfaces of the annular orifice channel 54 of the flare gas combustion apparatus 10.

To further assist in the prevention of the downward flow of air into the annular orifice channel 54, a restriction member 87 is disposed within the annular orifice channel 54 at a location above the first and second ring plate members 82 and 84, and below the exit port 55 of the annular orifice channel 54. The restriction member 87, which is centrally disposed in the annular orifice channel 54 and secured in place by spider members 89, cooperates with the first and second ring plate members 82 and 84 to selectively decrease the cross sectional area of the annular orifice channel 54 and thus to effect an increase in the velocity of the flare gas passing through the upper portion of the annular orifice channel 54. The placement of the restriction member 87 as shown creates turbulance in the flare gas just prior to its exiting the exit port 55, resulting in improved burning of the flare gas. While the restriction member 87 has been illustrated as a ring element having a rectangularly shaped cross section, it will be understood that the restriction member 87 can be fabricated to have any suitable cross sectional shape which will achieve the desired velocity and turbulence and increase in the exiting flare gas.

FIG. 4 is an enlargement of the exit port 55 of the annular orifice channel 54 which is formed at the top end of the flare tip assembly 40. Discharging gas is caused to form a cylindrical flow discharge pattern. As shown, this cylindrical discharge will be directed along the longitudinally extending axis of the flare tip assembly 40. However, it will be appreciated by persons of ordinary skill that this cylindrical discharge can be caused to diverge or to converge relative to said longitudinal axis by simply altering the angle of attachment of the first and second deflector rings 57, 61 as desired to direct the discharge of the flare gas. The first and second deflector rings 57, 61 also may be provided with a plurality of apertures (not shown) as may be required to achieve desirable flame characteristics. Disposed near the upper end of the flare tip assembly 40 is a conventional igniter assembly 90 (such as shown in FIGS. 1 and 2) that is used to ignite the discharging flare gas as required.

The flare tip assembly 40 also comprises an externally disposed fluid injector assembly 100 which is used for directing selected fluids into the perimeter zone discharge. The externally disposed fluid injector assembly 100 comprises a hollow pipe ring 102 supported around the flare housing 46 below the upper end thereof via standoff members 103. The hollow pipe ring 102 has a plurality of discharge apertures, and located about the pipe ring 102 are a plurality of fluid nozzles 104 that communicate with the discharge apertures. Each fluid nozzle (only a few are shown in the drawings, but the number may be established as required) extends upwardly from the pipe ring 102 and is disposed to discharge fluid toward the perimeter zone discharge as shown in FIG. 4. An inlet fluid conduit 106 is connected to the pipe ring 102 and is connected to a source of pressurized fluid such as air, natural gas, water or combination of such fluids. Of course, this list of possible fluids is illustrative only, and an appropriate fluid may be selected as required to effect the desired flame characteristics.

The flare gas combustion apparatus 10 depicted in FIGS. 1 through 3B is a two stage unit. As discussed above, flare gas enters the flare gas inlet conduit 14 at its first end 16 and a first flare gas portion enters the first flare conduit 30 via its lower end 32. The liquid in the seal tank 12 seals the second end 18 of the flare gas inlet conduit 14 until the flare gas entering the flare gas inlet conduit 14 reaches sufficient pressure to overcome the liquid head of the seal fluid, such as when emergency conditions require a greater amount of flare gas discharge than can be accommodated through the first flare conduit 30. Once the pressure of the incoming flare gas becomes great enough to blow the seal liquid, a second flare gas portion passes into the second flare conduit 34.

As shown in FIGS. 1 and 2, the second flare conduit 34 is coaxially disposed to the first flare conduit 30 so that a second annular orifice channel 110 is formed between the external wall of the first flare conduit 30 and the internal wall of the second flare conduit 34. The second annular orifice channel 110 extends the length of the second flare conduit 34 and continues between the external wall of the first flare conduit 30 and the internal wall of the liner cylinder 42 for the remaining length of the first flare conduit 30 where it communicates with the inner core 64 of the liner cylinder 42. The liner cylinder 42 is open at its upper end 44 so that the second flare gas portion passing via the flare gas inlet conduit 14 and the second annular orifice channel 110 to the inner core 64 of the liner cylinder 42 will be discharged upwardly as an inner zone discharge configured as a mass log. If required for a particular installation, a refractory lining 120 may be adhered to a portion of the internal wall of the liner cylinder 42 at its upper end 44 to protect the structure from this burning mass log of flare gas as well as to protect against flame licking of the liner cylinder 42 by the burning first flare gas portion during normal operations. (The refractory lining 120 is omitted from FIG. 3A to better show the other components.) The duration of flow of the second flare gas portion will usually be for a brief period of time, so this temporary passage of the second flare gas portion is acceptable. Once the emergency dumping conditions are over, and the pressure of the incoming flare gas will once again drop to normal, and the liquid seal can be re-established in the seal tank 12 by conventional means (not shown) that will sense the liquid level 20 and direct additional seal liquid into the seal tank 12 until the liquid level 20 rises to a predetermined height above the second end 18 of the flare gas inlet conduit 14.

Figure 5:
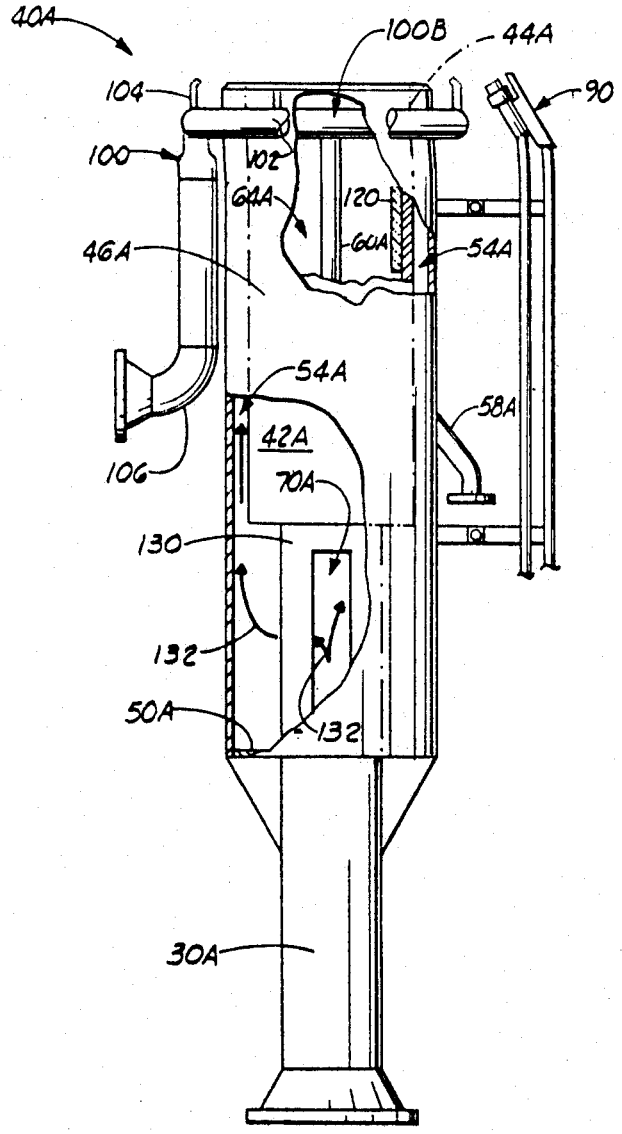
FIG. 5 is a partial cutaway of another flare tip assembly.
Figure 5:
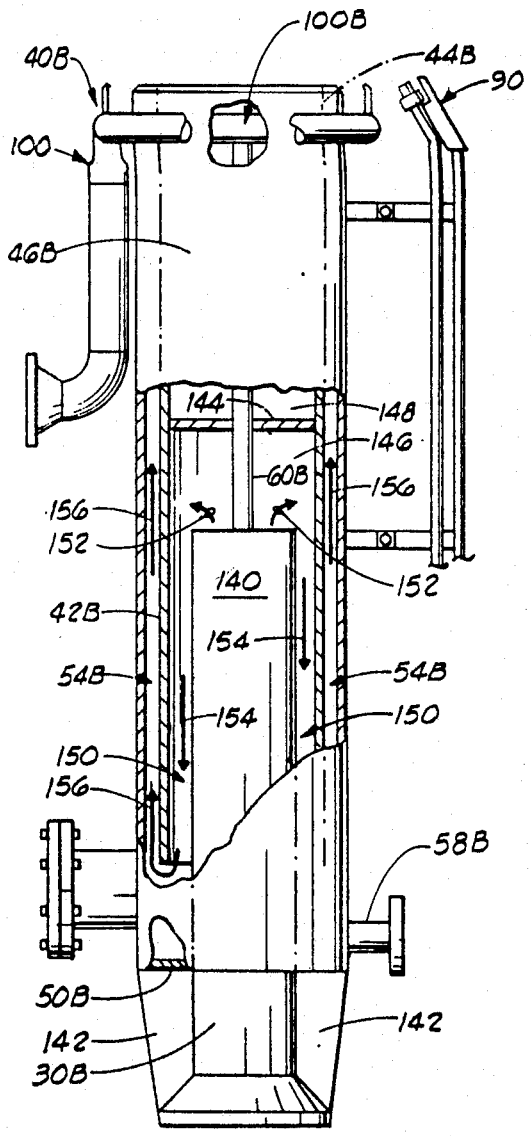

Shown in FIG. 5 is a single stage embodiment of a flare tip assembly 40A which attaches to the upper end of a conventional, single conduit flare stack (not shown). The flare tip assembly 40A functions in the same manner as does the flare tip assembly 40 with respect to the first flare gas portion which flows through the first flare conduit 30. That is, the flare gas discharge of the first flare gas portion will be configured as a relatively thin layer of cylindrically shaped flare gas. Similar numbers will be used to depict component parts of the flare tip assembly 40A which are similar to those described hereinabove for the flare tip assembly 40.

The flare tip assembly 40A comprises a bolt-on flare conduit section 30A which extends upwardly from a conventional flare stack, the flare conduit 30A having an upper end 130. Attached to the upper end 130 is a liner cylinder 42A having a bottom end wall (not shown) which is weldingly attached to the flare conduit 30A to seal it at its upper end 130. The liner cylinder 42A extends upwardly from the upper end 130 of the flare conduit 30A.

The flare tip assembly 40A also comprises a cylindrically or tubularly shaped flare housing 46A which is connected to the liner cylinder 42A by a number of vertical divider members (not shown but similar to the vertical divider members 48 described hereinabove for the flare tip assembly 40). An annular bottom plate 50A is welded to the flare housing 46A and to the outer wall of the flare conduit 30A. Formed between the coaxially disposed liner cylinder 42A and the flare housing 46A is an annular orifice channel 54A which is open at the upper end 44A of the liner cylinder 42A and sealed at the lower end by the bottom plate 50A. A fluid injector pipe 58A extends through the walls of the flare housing 46A and the liner cylinder 42A and has a vertically extensive leg 60A. The vertically extensive leg 60A is connected to and in fluid communication with the internally disposed fluid injector assembly 100B, described hereinbefore. At the upper end 130 of the flare conduit 30A are a plurality of flow openings 70A which provide fluid communication between the flare conduit 30A and the annular orifice channel 54A as indicated by the arrows 132.

As noted above, the flare tip assembly 40A is a single stage flare gas combustor, with provision for accommodating only a first flare gas portion; that is, there is no provision to accommodate a second flare gas portion as was the case for the earlier discussed flare tip assembly 40. In the flare tip assembly 40A, flare gas passes upwardly via the flare conduit 30A and passes via the plural flow openings 70A to the annular orifice channel 54A from which the flare gas discharges at the exit port provided at the top of the flare tip assembly 40A. The exit port of the flare tip assembly 40A is identical in construction detail to that described for the flare tip assembly 40 with reference to FIG. 4. The flare gas discharging from the annular orifice channel 54A forms a perimeter zone discharge. The flare tip assembly 40A may also be equipped with the externally disposed fluid injector assembly 100, described hereinbefore, and with the conventional igniter assembly 90. Also, the upper portion of the internal wall of the liner cylinder 42A may be lined with the refractory 120.

Another embodiment of a single stage flare tip assembly is shown in FIG. 6. Shown therein is a flare tip assembly 40B which attaches to the upper end of a conventional, single conduit flare stack (not shown). The flare tip assembly 40B functions in the same manner as does the flare tip assembly 40 with respect to the flare gas portion which flows through the first flare conduit 30. That is, as discussed above for the flare tip assembly 40A, the flare gas discharge of the first flare gas portion will be configured as a relatively thin layer of cylindrically shaped flare gas. For clarity, similar numbers will again be used to depict component parts of the flare tip assembly 40B which are similar to those described hereinabove for the flare tip assembly 40.

The flare tip assembly 40B comprises a bolt-on flare conduit section 30B which extends upwardly from a conventional flare stack, the flare conduit 30B having an open upper end 140. A cylindrically or tubularly shaped flare housing 46B is connected to the flare conduit 30B via a pair of gusset supports 142 and by an annular bottom plate 50B welded to the lower end of the flare housing 46B and to the outer wall of the flare conduit 30B. Disposed coaxially within the flare housing 46B is a liner cylinder 42B which is supported via a number of vertically extending divider members which are not shown but which are similar to the vertical divider members 48 described hereinabove for the flare tip assembly 40, the vertical divider members weldingly interconnecting the liner cylinder 42B and the flare housing 46B. Formed between the coaxially disposed liner cylinder 42B and the flare housing 46B is an annular orifice channel 54B which has an exit port at the upper end 44B of the liner cylinder 42B, the annular orifice channel 54B being sealed at its lower end by the bottom plate 50B.

The liner cylinder 42B has a seal plate 144 welded to the internal wall of the liner cylinder 42B and dividing same into a lower portion 146 and an upper portion 148. The flare conduit 30B extends upwardly into the lower portion 146 of the liner cylinder 42B, having its upper end 140 disposed below the seal plate 144. Formed between the inner wall of the liner cylinder 42B and the outer wall of the flare conduit 30B is an annularly shaped reverse flow channel 150, the reverse flow channel 150 having fluid communication with the annular orifice channel 54B as shown in FIG. 6. A fluid injector pipe 58B extends through the walls of the flare housing 46B and the liner cylinder 42B and is connected to and in fluid communication with the externally disposed fluid injector 100B, described hereinbefore.

The flare tip assembly 40B is a single stage flare gas combustor, with provision for accommodating only a first flare gas portion; that is, there is no provision to accommodate a second flare gas portion as was the case for the earlier discussed flare tip assembly 40. In the flare tip assembly 40B, flare gas passes upwardly via the flare conduit 30B and flows from the upper end 140, the upward flow thereof being blocked by the plate 144 which serves to seal the upper portion 148 of the liner cylinder 42B. The flare gas is caused to reverse its upward direction to flow downwardly through the annularly shaped reverse flow channel 150 as indicated by the arrows 152 and 154. The lower end of the liner cylinder 42B is disposed somewhat above the bottom plate 50B, and the gas discharging from the reverse flow channel 150 is again caused to reverse its direction and to flow upwardly into the annular orifice channel 54B, as indicated by the arrows 156; the flare gas discharges at the exit port of the annular flow channel 54B provided at the top of the flare tip assembly 40B. The exit port of the flare tip assembly 40B is identical in construction detail to that described for the exit port 55 of the flare tip assembly 40 with reference to FIG. 4. The flare gas discharging from the annular orifice 54B forms a perimeter zone discharge as indicated by the arrow 80 in FIG. 6.

The flare tip assembly 40B may also be equipped with the externally disposed fluid injector assembly 100, described hereinabove, and with the conventional igniter assembly 90. Also, the upper portion of the internal wall of the liner cylinder may be lined with a refractory (not shown) if required to protect the structure from the burning flare gas.

While the flare tip assembly 40B performs the same function as the flare tip assembly 40A in discharging the flare gas as a perimeter zone discharge as described above, the flare tip assembly 40B further provides a reverse flow seal chamber between the flare conduit 30B and the annular orifice channel 54B. During purge operations, this reverse flow seal chamber serves to entrap a portion of the purge gas generally within the space formed in the reverse flow channel 150 below the seal plate 144 and the lower portion of the annular orifice channel 54B, and this occurs whether the purge gas is heavier or lighter than atmospheric air. The result of this purge gas entrapment is to minimize the amount of purge gas required to retard the backflow of atmospheric air into the flare stack.

Figure 7:
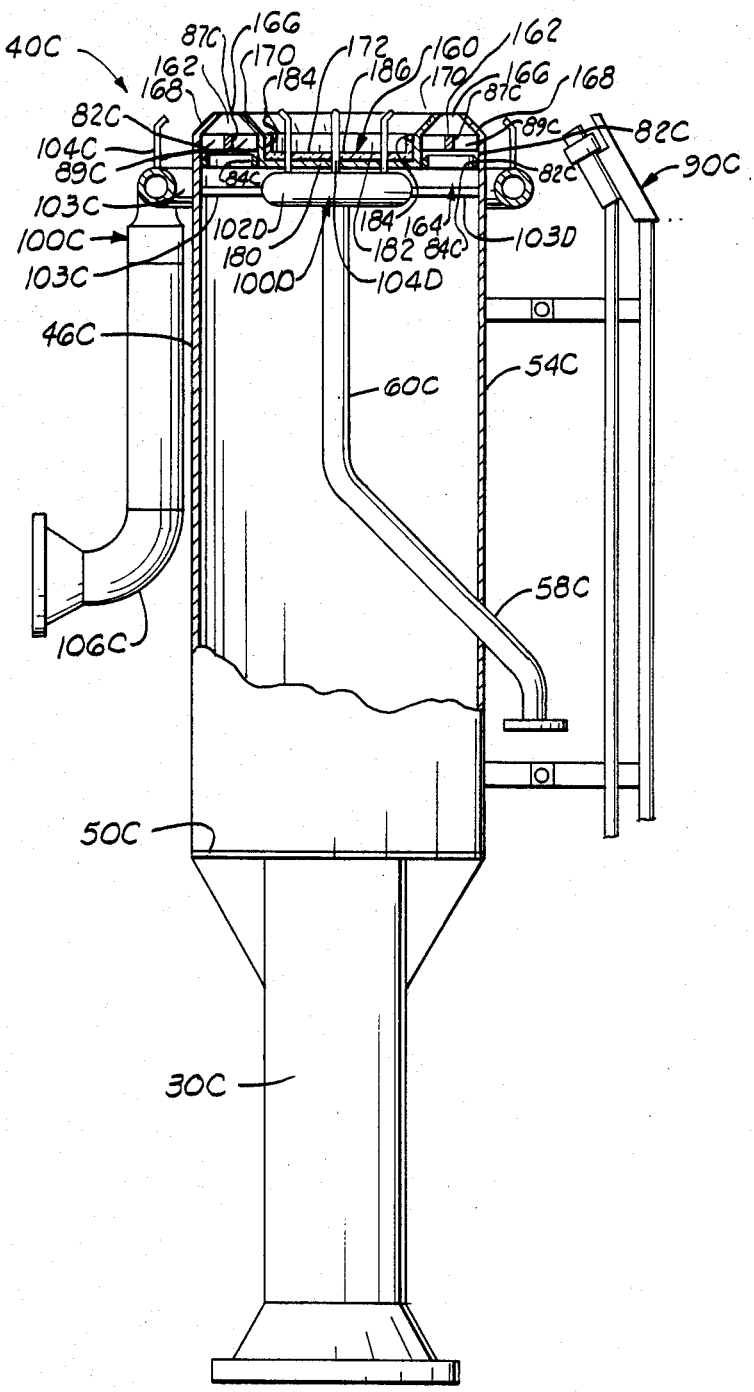
FIG. 7 is a partial cutaway view of still another flare tip assembly.
Figure 5:
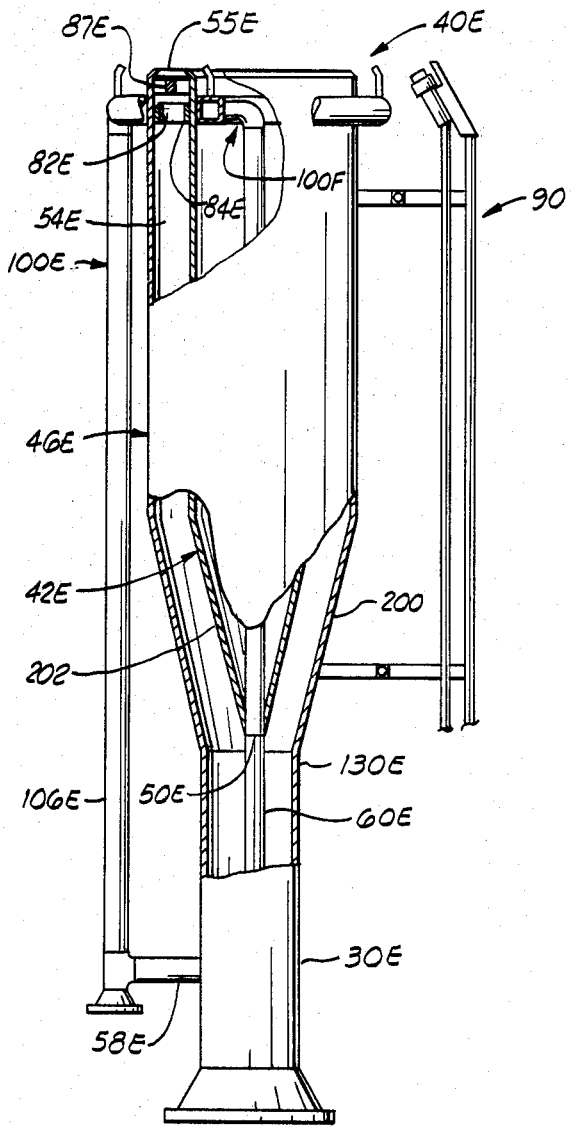
Figure 5A:
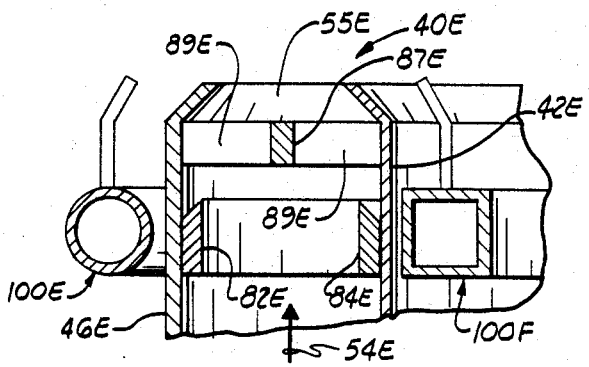
Figure 5B:
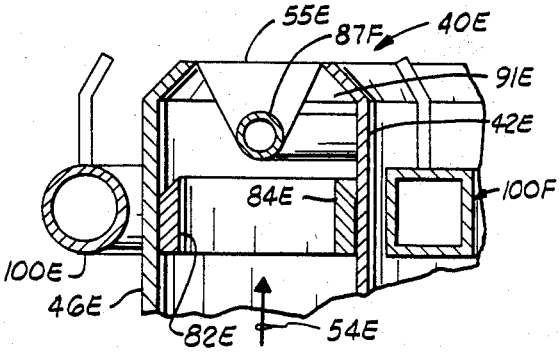

Shown in FIG. 7 is another single stage embodiment of a flare tip assembly 40C which attaches to the upper end of a conventional, single conduit flare stack (not shown). The flare tip assembly 40C functions in the same manner as does the flare tip assembly 40 with respect to the first flare gas portion which flows through the first flare conduit 30. That is, the flare gas discharge of the first flare gas portion will be configured as a relatively thin layer of cylindrically shaped flare gas. Similar numbers will be used to depict component parts of the flare tip assembly 40C which are similar to those described hereinabove for the flare tip assembly 40.

The flare tip assembly 40C comprises a bolt-on flare conduit section 30C which extends upwardly from a conventional flare stack, and a cylindrically or tubularly shaped flare housing 46C. An annular bottom plate 50C is welded to the flare housing 46C and to the outer wall of the flare conduit 30C.

As noted above, the flare tip assembly 40C is a single stage flare gas combustor, with provision for accommodating only a first flare gas portion; that is, there is no provision to accommodate a second flare gas portion as was the case for the earlier discussed flare tip assembly 40. In the flare tip assembly 40C, flare gas passes upwardly via the flare conduit 30C and passes into the flare housing 46C for discharge at the top of the flare tip assembly 40C.

The flare tip assembly 40C further comprises a cap assembly 160 centrally disposed in an upper portion of the flare housing 46C. The cap assembly 160 is supported in the upper portion of and connected to the inner wall of the flare housing 46C by a number of connecting members 162 such that an annular passageway 164 is formed between the cap assembly 160 and the inner wall of the flare housing 46C. Thus, flare gas passing through the flare conduit 30C and the flare housing 46C exits the flare housing 46C via the annular passageway 164 and an exit port 166 as a relatively thin layer of cylindrically shaped flare gas.

The exit port 166 of the annular orifice passageway 164 is defined by a first deflector ring 168 supported by the upper end of the flare housing 46C, and a second deflector ring 170 supported by the cap assembly 160. The first and second deflector rings 168, 170 are angularly disposed in a converging direction (substantially as shown) so that the cross sectional area of the exit port 166 is less than the cross sectional area of the annular passageway 164.

The cap assembly 160 comprises a substantially circular shaped plate member 180 having an upper surface 182 and an upstanding rim portion 184 disposed along the edge or circumference of the plate member 180. The second deflector ring 170 is supported by the upstanding rim portion 184 of the plate member 180. The upstanding rim portion 184 of the plate member 180 and the second deflector ring 170 can be formed as a unitary member or as separate elements. A refractory liner 186 may be adhered to the upper surface 182 of the plate member 180 and to the inwardly facing portions of the upstanding rim portion 184 of the plate member 180 to protect such elements from the burning of the flare gas discharge through the exit port 166 of the flare housing 46C.

To prevent air from migrating downwardly along the interior wall of the flare housing 46C during periods of low flow rates of the flare gas, and during purging operations, first and second ring plate members 82C, 84C and restriction member 87C are disposed within the annular orifice passageway 164 and secured to the flare housing 46C so as to provide a partial restriction in the annular orifice passageway 164. These ring plate members 82C, 84C and the restriction member 87C are substantially identical in construction to the first ring plate member 82 and the restriction member 87 described with reference to the flare housing 46 hereinbefore. The first and second ring plate members 82C, 84C are disposed within the annular orifice passageway 164 such that their beveled end portions extend in the direction of the top portion of the flare housing 46C and form an acute angles with the elongated axis of the flare housing 46C.

The flare tip assembly 40C also comprises an externally disposed fluid injector assembly 100C which is used for directing selected fluids into the perimeter zone discharge. The externally disposed fluid injector assembly 100C comprises a hollow pipe ring 102C supported around the flare housing 46C below the upper end thereof via standoff members 103C. The hollow pipe ring 102C has a plurality of discharge apertures, and located about the pipe ring 102C are a plurality of fluid nozzles 104C that communicate with the discharge apertures. Each fluid nozzle (only a few are shown in the drawings, but the number may be established as required) extends upwardly from the pipe ring 102A and is disposed to discharge fluid toward the perimeter zone discharge. An inlet fluid conduit 58C is connected to the pipe ring 102C and is connected to a source of pressurized fluid such as air, natural gas, water or combination of such fluids. Of course, this list of possible fluids is illustrative only, and an appropriate fluid may be selected as required to effect the desired flame characteristics.

A fluid injector pipe 58C extends through the walls of the flare housing 46C and has a vertically extensive leg 60C. The end of the injector pipe 58C is connected to and in fluid communication with an internally disposed fluid injector assembly 100D which is disposed below the upper end of the flare housing 46C and the plate member 180 of the cap assembly 160.

The internally disposed fluid injector 100D comprises a hollow pipe ring 102D having a plurality of discharge apertures, and located about the pipe ring 102D are a plurality of fluid nozzles 104D that communicate with the discharge apertures and extend through aligned openings in the plate member 180 and the refractory liner 186. Each fluid nozzle (only a few are shown in the drawings, but the number may be established as required) extends upwardly from the pipe ring 102D, through the aligned openings in the plate member 180 and the refractory liner 186 so that the fluid nozzles 104D are disposed to discharge fluid, such as steam, air, natural gas, water, or combinations of such fluids, into the perimeter zone discharge. Disposed near the upper end of the flare tip assembly 40C is a conventional lighter 90C that is used to ignite the discharging flare gas as required.

Shown in FIG. 8 is a single stage embodiment of a flare tip assembly 40E which attaches to the upper end of a conventional, single conduit flare stack (not shown). The flare tip assembly 40E functions in the same manner as does the flare tip assembly 40 with respect to the first flare gas portion which flows through the first flare conduit 30. That is, the flare gas discharge of the flare gas will be configured as a relatively thin layer of cylindrically shaped flare gas. Similar numbers will be used to depict component parts of the flare tip assembly 40E which are similar to those described hereinabove for the flare tip assembly 40.

The flare tip assembly 40E comprises a bolt-on flare conduit section 30E which extends upwardly from a conventional flare stack, the flare conduit section 30E having an upper end 130E. Attached to the upper end 130E is a flare housing 46E which is substantially cylindrically shaped with an outside diameter greater than the outside diameter of the flare conduit section 30E so as to provide the flare housing 46E with a converging lower end portion 300 substantially as shown. A liner member 42E, a substantially cylindrically shaped member having a converging lower end portion 202, is disposed within and connected to the flare housing 46E by a number of vertical divider members (not shown but similar to the vertical divider members 40 described hereinabove for the flare tip assembly 40) so that an annular orifice channel 54E is formed therebetween. A fluid injector pipe 58 is fluidly connected to an inlet fluid conduit 106E of an externally disposed fluid injector assembly 100E, and the fluid injector pipe 58E extends through the walls of the flare housing 46E. The fluid injector pipe 58E is further characterized as having a vertically extensive leg 60E which extends upwardly through the liner member 42E. An annular bottom plate 50E is welded to the lower end of the liner member 42E and the adjacently disposed portion of the vertically extensive leg 60E of the fluid injector pipe 58E to form a fluid tight seal therebetween. The vertically extensive leg 60E is connected to and in fluid communication with an internally disposed fluid injector assembly 100F. The externally disposed fluid injector assembly 100E and the internally disposed fluid injector assembly 100F are similar in construction and function to the fluid injector assemblies 100 and 100A described with reference to the previously described figures.

As noted above, the flare tip assembly 40E is a single stage flare gas combustor, with provisions for accommodating only a first flare gas portion; that is, there is no provision to accommodate a second flare gas portion as was the case for the earlier discussed flare tip assembly 40. In the flare tip assembly 40E, flare gas passes upwardly via the flare conduit 30E and into the annular orifice channel 54E from which the flare gas discharges at an exit port 55E provided at the top of the flare tip assembly 40E. The exit port 55E of the flare tip assembly 40E is identical in construction to that described for the flare tip assembly 40 with reference to FIG. 4. The flare gas discharging from the annular orifice channel 54E forms a perimeter zone discharge. The flare tip assembly 40E may also be equipped with the externally disposed fluid injector 100, described hereinbefore, and with the conventional igniter assembly 90.

Referring now to FIGS. 8, 9A and 9B, the flare tip assembly 40E further comprises first and second ring plate members 82E, 84E disposed within the annular orifice channel 54E so as to provide a partial restriction in the annular orifice channel 54E in the same manner and for the same purpose as the first and second ring plate members 82, 84 hereinbefore described with reference to the flare assembly 40 of FIG. 4. The flare tip assembly 40E further comprises a restriction member 87E disposed within the annular orifice channel 54E at a location between the first and second ring plate members 82E and 84E, and the exit port 55E of the annular orifice channel 54E in the manner previously described hereinabove via spider members 89E.

FIG. 9A illustrates an alternative form of the restriction member disposed within the flow channel 54E. A plurality of brackets 91E are provided to support a circular cross section ring 87F. Whether the rectangular cross section restruction member 87E (of FIG. 9A) or the ring shaped restriction member 87F is utilized, it will be understood that the restriction member cooperates with the first and second ring plate members to prevent air from migrating downwardly along the interior surfaces of the annular orifice channel by producing turbulence in the flare gas exiting the exit port of the flare tip assembly while maintaining the flare gas at an increased velocity in the upper portion of the annular orifice channel.

It is clear that the present invention is well adapted to carry out the objects and to attain the ends and advantages mentioned as well as those inherent therein. While presently preferred embodiments of the invention have been described for purposes of this disclosure, it will be recognized that numerous changes may be made which will readily suggest themselves to those skilled in the art and which are encompassed within the spirit of the invention disclosed and as defined in the appended claims.

What is claimed is:

1. An improved smoke suppressant apparatus for flare gas combustion comprising:

a flare housing having an upper end;

a liner cylinder having first and second ends and coaxially supported within the flare housing, the liner cylinder forming an annular orifice channel between the inner wall of the flare housing and the outer wall of the liner cylinder;

a first flare conduit connected in fluid communication with the annular orifice channel so that a first flare gas portion passing through the first flare conduit is discharged from the orifice channel at an exit port of the annular orifice channel at the upper end of the flare housing, the first flare gas portion discharging from the exit port of the annular orifice channel forming a cylindrically shaped perimeter zone discharge;

internally disposed fluid injector means positioned within the upper portion of the flare housing for injecting selected fluids into the cylindrically shaped perimeter zone discharge of the first flare gas portion;

externally disposed injector means secured around the upper portion of the flare housing for injecting selected fluids into the cylindrically shaped perimeter zone discharge of the first flare gas portion; and annular ring plate means disposed within the orifice channel for preventing air from backflowing along surfaces of the housing at first liner member defining the orifice channel, the annular plate means comprising:

a first ring plate member having an upper beveled end portion, the first ring plate member being disposed within the orifice channel and secured to an inner wall of the housing such that the beveled end portion of the first ring plate member forms an acute angle with the elongated axis of an upper portion of the housing; and a second ring plate member having an upper beveled end portion, the second ring plate member being disposed within the orifice channel and secured to an outer wall of the first liner member such that the beveled end portion of the second ring plate member forms an acute angle with the elongated axis of an upper portion of the first liner member.

2. An improved smoke suppressant apparatus for flare gas combustion comprising:

a tubularly shaped flare housing having an upper end and an inner wall;

gas directing means disposed within the flare housing for causing an orifice channel to be formed between the gas directing means and the upper end of the flare housing, and comprising:

a liner member having first and second ends and an outer wall; and means for attaching the liner member to the flare housing so that the liner member is supported within the flare housing, the orifice channel formed thereby between the inner wall of the flare housing and the outer wall of the liner member, and an exit port of the orifice channel being disposed at the upper end of the flare housing, the first flare gas portion discharging from the orifice channel forming a perimeter zone discharge from the exit port;

annular ring plate means disposed within the orifice channel for preventing air from backflowing along surfaces of the housing and first liner member defining the orifice channel, and the annular ring plate means comprising:

a first ring plate member having an upper beveled end portion, the first ring plate member being disposed within the orifice channel and secured to the inner wall of the housing such that the beveled end portion of the first ring plate member forms an acute angle with the elongated axis of an upper portion of the housing; and a second ring plate member having an upper beveled end portion, the second ring plate member being disposed within the orifice channel and secured to the outer wall of the liner member such that the beveled end portion of the second ring plate member forms an acute angle with the elongated axis of an upper portion of the liner member;

a flare conduit connected in fluid communication with the orifice channel so that a first flare gas portion passing through the flare conduit is exhausted from the orifice channel at the exit port of the orifice channel; and internally disposed fluid injector means positioned within the upper end of the flare housing such that selected fluid can be injected into the first flare gas portion exiting the orifice channel via the exit port.

* * * * *

UNITED STATES PATENT AND TRADEMARK OFFICE

CERTIFICATE OF CORRECTION

PATENT NO. : 4,824,361

DATED : April 25, 1989

INVENTOR(S) : Eugene C. McGill and Robert L. Rawlings

It is certified that error appears in the above-identified patent and that said Letters Patent is hereby corrected as shown below:

ON TITLE PAGE: Section [56] References Cited, U.S. PATENT DOCUMENTS, delete "4,188,783" and substitute --4,188,183-- therefor; and Column 2, line 42, after "via" delete "a" and substitute --an-- therefor.

Signed and Sealed this

Tenth Day of September, 1991

*Attest:*

HARRY F. MANBECK, JR.

*Attesting Officer*

*Commissioner of Patents and Trademarks*